US005401018A

United States Patent [19]

Kelly et al.

[11] Patent Number: 5,401,018

[45] Date of Patent: Mar. 28, 1995

[54] BASEBALL SIMULATION GAME

[75] Inventors: Bryan M. Kelly, Dublin; Norman B. Petermeier, Saratoga; Matthew F. Kelly, Dublin, both of Calif.

[73] Assignee: Lazer-Tron Corporation, Pleasanton, Calif.

[21] Appl. No.: 975,228

[22] Filed: Nov. 13, 1992

[51] Int. Cl.[6] ..... A63B 69/40

[52] U.S. Cl. ..... 273/26 E; 273/26 R; 273/90; 273/185 C; 273/85 G

[58] Field of Search ..... 273/25, 26 R, 26 E, 273/26 EA, 26 A, 85 G, 35 R, 184 R, 185 C, 85 R, 90

[56] References Cited

U.S. PATENT DOCUMENTS

| | | | |
|---|---|---|---|
| 2,839,300 | 1/1956 | Blaha et al. | 273/36 |
| 3,537,208 | 1/1972 | Allred | 273/26 E |
| 3,980,304 | 9/1976 | O'Neill et al. | 273/26 |
| 4,150,825 | 4/1979 | Wilson | 273/185 |
| 4,177,994 | 12/1979 | Lindquist | 273/176 |
| 4,461,477 | 7/1984 | Stewart | 273/26 |
| 4,563,005 | 1/1986 | Hand et al. | 273/26 |
| 4,632,394 | 12/1986 | Ryan | 273/26 |
| 4,733,865 | 3/1988 | Reed | 273/26 |
| 4,763,903 | 8/1988 | Goodwin et al. | 273/371 |
| 4,767,121 | 8/1988 | Tonner | 273/185 |
| 4,815,735 | 3/1989 | McClenny | 273/26 |
| 4,915,384 | 4/1990 | Bear | 273/26 |
| 4,941,662 | 7/1990 | DePerna | 273/25 |
| 4,993,709 | 2/1991 | Tominaga | 273/29 |
| 4,995,607 | 2/1991 | Whitfield | 273/26 R |
| 5,040,791 | 8/1991 | Ratajac et al. | 273/26 |
| 5,067,079 | 11/1991 | Smith, III et al. | 364/410 |
| 5,082,262 | 1/1992 | Sanchez | 273/26 |
| 5,106,085 | 4/1992 | Lewy | 263/26 |
| 5,149,093 | 9/1992 | Schilling et al. | 273/118 A |

*Primary Examiner*—Vincent Millin
*Assistant Examiner*—Kerry Owens
*Attorney, Agent, or Firm*—Hickman & Beyer

[57] ABSTRACT

An arcade game simulating a baseball game. A player hits a ball suspended in front of him or her at a known initial position towards a detector assembly, such as an x-y grid of light beams. The initial velocity of the ball is accurately determined by calculating the speed of the ball by measuring the time it took the ball to travel between its initial and final positions, and by calculating the direction of the ball from the known initial and final positions of the ball. Audio and visual feedback may be provided to the player of the game unit based upon the results of the hit ball and based upon a baseball game environment. Awards can also be dispensed to the player by the game unit based upon a score accumulated during the game.

37 Claims, 6 Drawing Sheets

BASEBALL SIMULATION GAME

BACKGROUND OF THE INVENTION

1. Field of the Invention

This invention relates to arcade games and more particularly to game simulators.

2. Background of the Related Art

Game practice and game simulation apparatus are well-known in the gaming industry. For example, there are a great many machines which will allow a user to practice golf or baseball skills, or to play a simulated golf game.

Game simulations allow a player to experience game action or to improve his or her skill in a game more conveniently and in less time than when playing a real game. Baseball game practice apparatus usually include a ball and a playing area to hit the ball into with a club or bat, and often also include a method to determine how well a player hit the ball.

In U.S. Pat. No. 5,040,791, A. Ratajac describes a collapsible, portable batting cage in which a ball is suspended at an adjustable hitting position by four shock cords attached to the cage frame. The ball is hit by a player into a net stretched across the rear of the cage frame.

In U.S. Pat. No. 4,941,662, J. DePerna describes a baseball game in which a pitcher player pitches a ball at a batting player, who hits the ball into a number of ball sensing field zones facing the batter. The type of hit can be designated a hit, foul, or out from the location of the sensing zone that the ball penetrated and the mount of time the ball took to reach the sensing zone.

In U.S. Pat. No. 4,915,384, R. Bear describes an adaptive sports training system in which a ball is delivered to and hit by a player at a target grid, which evaluates the skill of the hit and modifies the skill level of the game accordingly.

Baseball practice apparatus of the prior art, while convenient and enjoyable, are rather limited in their accuracy in determining the trajectory of a hit ball and determining the result of the hit. In the prior art, the speed of the ball and the final position of the ball are often measured, but the velocity (speed and direction) of the ball is not calculated. Without an accurate method for measuring and calculating ball velocity, the accuracy of any game simulation would be low. Prior art baseball apparatus are also limited in their ability to provide feedback to the player concerning his or her performance in the game and do not generally allow a user to play a simulated game of baseball. These limitations can lead to rapid player boredom and frustration and can be undesirable if the game is played in an arcade environment, where the revenue of the games depends on player interest and use of the games.

SUMMARY OF INVENTION

The present invention provides an apparatus and method to play a simulated baseball game. This is accomplished, in part, by accurately determining the velocity of a hit ball, i.e. both the speed and direction of the ball. In this way, the apparatus of the present invention is much more than a baseball practice game: it becomes an accurate baseball simulator machine. These features add excitement and complexity to the game, which tends to prolong player involvement.

The baseball simulator of the present invention comprises a wailed frame inside which a ball is suspended in front of the player by cords or a similar supporting structure. The suspended ball faces a detector assembly comprising an x-y sensing grid. A player hits the ball with a bat towards the detector assembly, which detects the coordinates of the ball as it impinges upon the detection assembly. The ball then returns to its initial position due to the elasticity of the support cords.

The initial velocity and a simulated trajectory of the ball are accurately calculated by a digital computer. The computer calculates velocity from speed and direction information received from the game's sensors. The speed is determined by dividing the distance the ball travelled by the time the ball took to travel from its initial position to the detector assembly. The time is measured by starting a timer when the ball is first hit and stopping the timer when the ball reaches the detector assembly. The timer is connected to a support cord attached to the ball so that when the ball initially moves, the timer is activated.

The computer calculates the direction of the ball by using a formula requiring the coordinates of the initial position and the final position of the ball. The initial position is a known constant, and the final position is detected by the detector assembly. Once the initial velocity (i.e. speed and direction) of the ball are known, the computer can calculate a simulated trajectory of the ball with a high degree of accuracy. The computer also determines whether any simulated fielding players are able to catch the ball and if the hit is an out, a foul, or a scoring/base hit. A score display is adjusted accordingly, and audio and visual feedback is provided according to the result of the hit. A variation of the simulator game adds an award dispensed to the player according to the result of the game.

The game simulator adds accuracy to the simulation of the trajectory of the hit ball, creating a more realistic game. With such accurate simulations, player interest is heightened and the challenge to the player is significantly increased. The audio and visual feedback provide a player with a game atmosphere and add interest to the game as well, increasing the revenue produced by the game.

These and other advantages of the present invention will become apparent to those skilled in the art after reading the following descriptions and studying the various figures of the drawings.

DETAILED DESCRIPTION OF THE PREFERRED EMBODIMENTS

Figure 1:
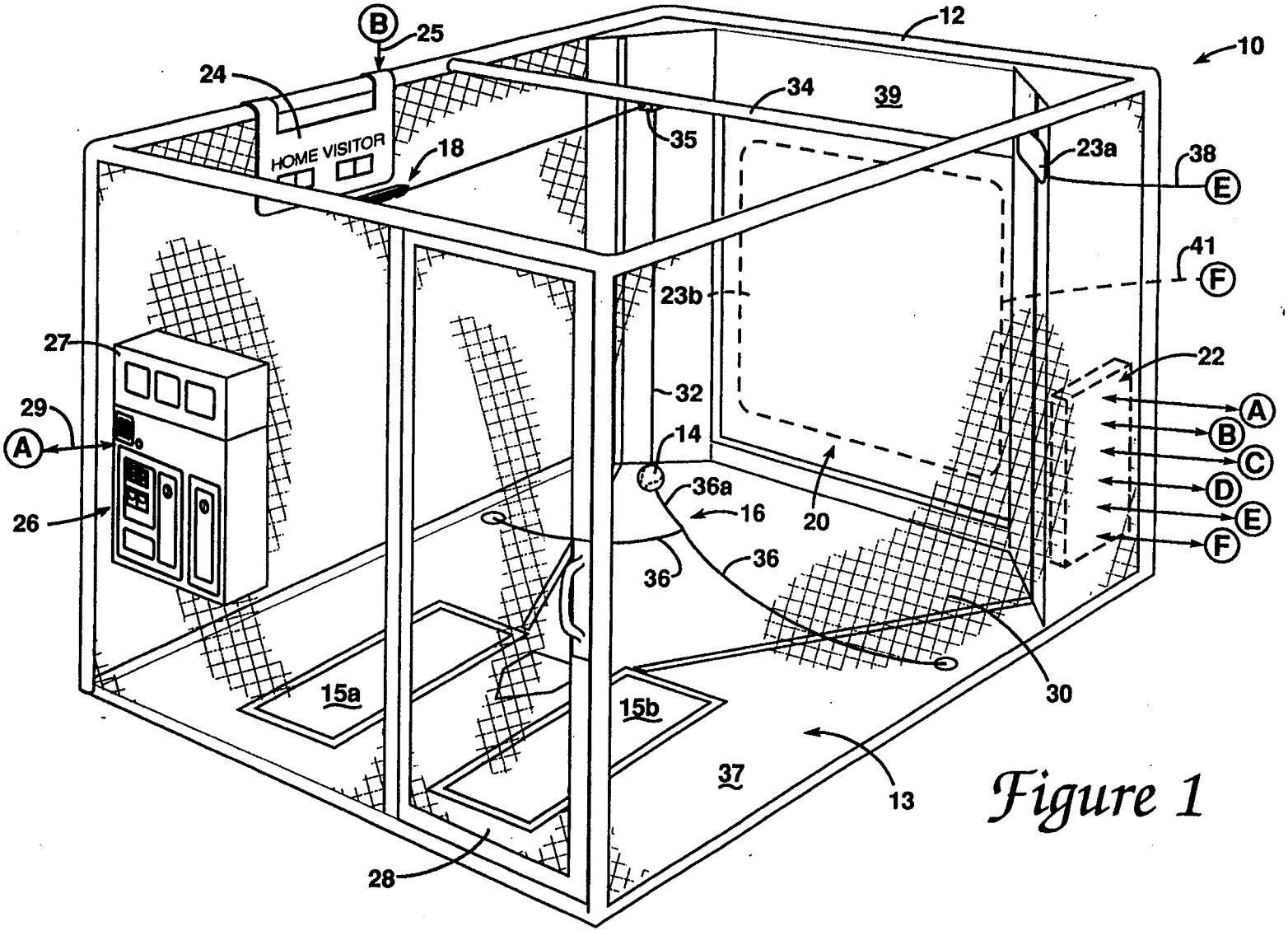
FIG. 1 is a perspective view of the simulation game unit in accordance with the present invention.

In FIG. 1, a game simulator unit 10 in accordance with the present invention includes a frame 12 defining a batting cage 13, a ball 14, support assembly 16, detector assembly 20, a digital computer 22, feedback assemblies 23*a* and 23*b*, a display 24, a coin box 26, and a control panel 27.

In the preferred embodiment, one player plays the game at a single time by standing within batting cage 13 in batting box 15*a* or 15*b* depending upon whether they are right or left handed, respectively. Alternate embodiments can permit more players to play at one time by permitting players to take turns hitting the ball, etc.

Frame 12 is preferably a metal, rectangular prism defining the batting cage 13. A door 28 in frame 12 permits player entry and exit from the batting cage 13. Fencing material 30 is supported by the frame 12 so that outside onlookers are protected from balls hit by the player and from the swinging bat.

Ball 14 is suspended near the center of the batting cage 13. The ball is typically a baseball or softball, but it can also be any suitable object for being hit by a player. The ball 14 is suspended by support assembly 16, which holds the ball 14 in a known initial position and returns the ball to that initial position after the ball has been hit.

Typically, the support assembly 16 includes cords or other flexible cables that can hold the ball 14 in the known, initial position. The support means 16 can also comprise other embodiments, such as a pedestal that holds the ball 14 at a specific height, a support beam projecting from the frame 12, or a similar structure that holds the ball 14 at a known initial position and returns the ball to that initial position.

The support assembly 16 is secured to the ball 14 preferably by passing a support cord through a hole in the ball and securing the ball to the cord with fasteners. Other devices can also be used that secure the ball 14 to the support assembly 16 securely enough so that the ball can be hit with a bat and remain connected to the support assembly 16.

The support assembly 16 in the preferred embodiment includes a ball suspension cord 32 which extends upwardly from the ball 14 towards a support beam 34 of frame 12, passes through an eyelet 35, and extends horizontally to the back end of the frame 12 where it is anchored by sensing assembly 18. Two guide tethers 36 are connected to the ball 14 by a short cord 36*a* and to the floor 37 of the game unit 10. The ball suspension cord 32 and the two guide tethers 36 stabilize the ball 14 and hold the ball 14 at a known initial position. In the preferred embodiment, the vertical cord 32 is an elastic or "bungee" cord operative to bring the ball 14 back to its initial position if the ball is hit, and the guide ropes 36 prevent the ball 14 from being hit too far to the right or the left and stop the ball after it has recoiled from hitting detector assembly 20.

A sensing assembly 18 is located at the back end of the frame 12 and is coupled to the ball suspension cord 32. The sensing assembly 18 starts the timer that measures the time of the ball's flight. The sensing assembly 18 is detailed subsequently with reference to FIG. 4.

Detector assembly 20 is spaced from the ball 14 by about three feet. In the preferred embodiment, detector assembly 20 includes a screen 39 and an x-y grid of sensors located in front of the screen. The detector assembly 20 is positioned so that a player hits the ball towards the screen 39, and the ball's final position is detected by the sensor grid before or as the ball 14 collides with the screen 39. The detector assembly preferably detects the cartesian coordinates of the ball 14 and also stops the timer. The coordinates and elapsed time are used by the computer to calculate the velocity and a simulated trajectory of the ball (described below). The detector assembly is more fully described with reference to FIG. 5.

Digital computer 22 receives information sent to it by the sensor grid and timer. The computer is preferably a microprocessor-controlled digital apparatus with several input/output ports. The computer includes six input/output ports A, B, C, D, E, and F, coupled to input/output (I/O) devices of the game unit by lines, cables, or busses. The I/O devices include detector assembly 20, sensing assembly 18, feedback assemblies 23*a* and 23*b*, display 24, coin box 26, and control panel 27. The computer system 22 is described in greater detail with reference to FIG. 7.

Feedback assemblies 23*a* and 23*b* output audio and (optionally) visual feedback, respectively, to the player based upon the calculated result of the hit. The feedback assembly 23*a* includes a speaker, which outputs audio sound effects and announcer voices to the player during the game. The computer 22 controls the sound effects by sending signals from an output port E on cable 38 to the speaker 23*a*.

Feedback assembly 23*b* includes a video screen that can display computer-controlled graphical images based on the hit result. Video screen 23*b* is coupled to output port F on the computer 22 by cable 41. Computer 22 sends video signals on cable 41 that display animated graphics images on the screen 23*b*. Such images include a baseball playing field, a ball in flight, fielding players, a pitcher, base runners, a crowd, etc. Preferably the images are computer animated or stored on videodisc by techniques well-known in the art. In an alternate embodiment, feedback assembly 23*b* includes a projector located in front of screen 39. The projector is operative to project graphical images onto screen 39 from the front and is controlled by computer 22 similarly to the video screen described above.

Display 24 is placed on the inside of the frame 12 to facilitate easy viewing by the player and is preferably an LED or LCD display coupled to output port B of the digital computer 22 by a bus 25. The display 24 shows game status information and score. In the preferred embodiment, the display shows the number of runs scored by one or two players, the number of fouls and outs currently accumulated, and the current inning number. The display can also show team names, player names, player statistics, inning scores, advertisements, or other information normally displayed at a baseball game.

Coin box 26 is located outside the batting cage 13 and is coupled to port A of the computer 22 by a bus 29. Players preferably insert a coin or token to play the game before entering the batting cage 13. Coin box 26 is described in greater detail with reference to FIG. 6.

Control panel 27 is preferably located adjacent to the coin box 26. Panel 27 is coupled to I/O port A of computer 22 by the same bus 29 that couples the coin box 26 to computer 22. Panel 27 includes controls for the player to select different parameters in the game, such as skill level, opponent team, team names, player alias, ballpark name and look, and ball height from the ground. Preferably, these controls are activated by the player after inserting a coin into the coin box 26 and prior to entering the batting cage 13.

Figure 2:
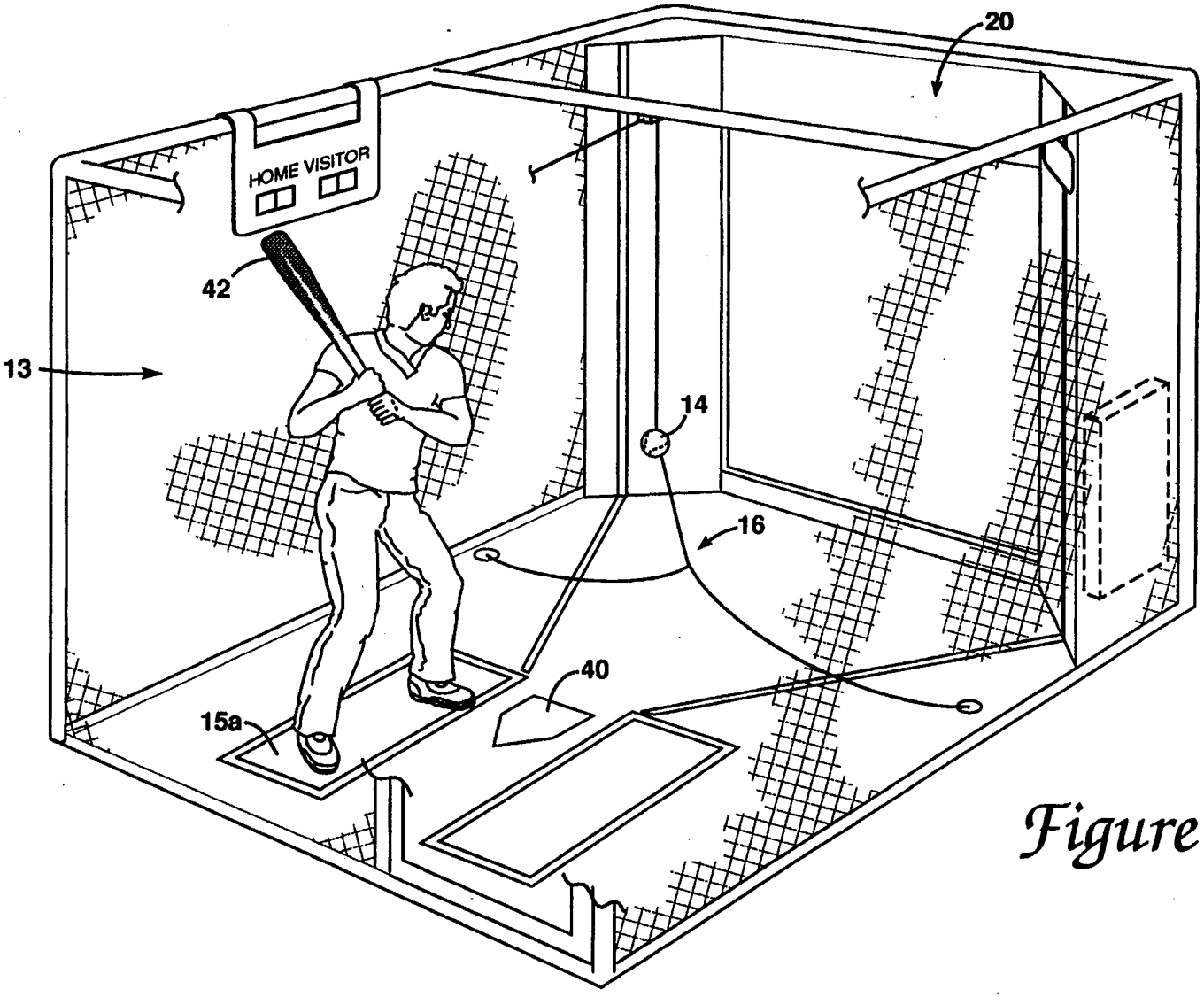
FIG. 2 is a perspective view of a player playing the simulation game unit.

FIG. 2 is a perspective view of game simulation unit 10 with a player standing within the batting cage 13. The player is standing in the batting box 15*a* adjacent a plate 40 as in a normal game of baseball. The ball 14 is hit with a bat 42 so that the ball flies toward detector assembly 20. Support means 16 returns the ball 14 back to its initial, resting position. The player can then hit the ball again if the game has not ended. In the preferred embodiment, bat 42 is connected to frame 12 by a chain or the like (not shown) to prevent the bat from being removed from the batting cage 13.

Figure 3:
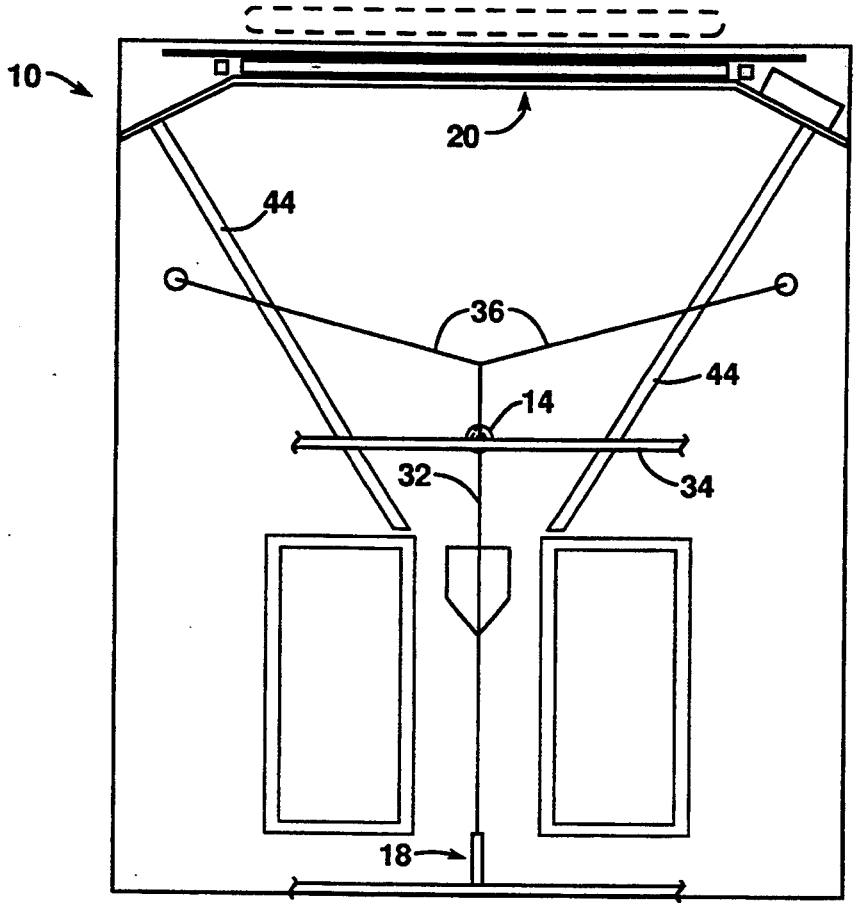
FIG. 3 is a schematic top plan view of the game simulation unit.

FIG. 3 shows a schematic, top plan view of the game simulation unit 10. The initial position of the ball 14 is preferably directly under the support beam 34. Field perimeter lines 44 define the area where the ball 14 may be hit by the player; preferably, side tethers 36 prevent the ball 14 from being hit outside of the lines 44.

Figure 4:
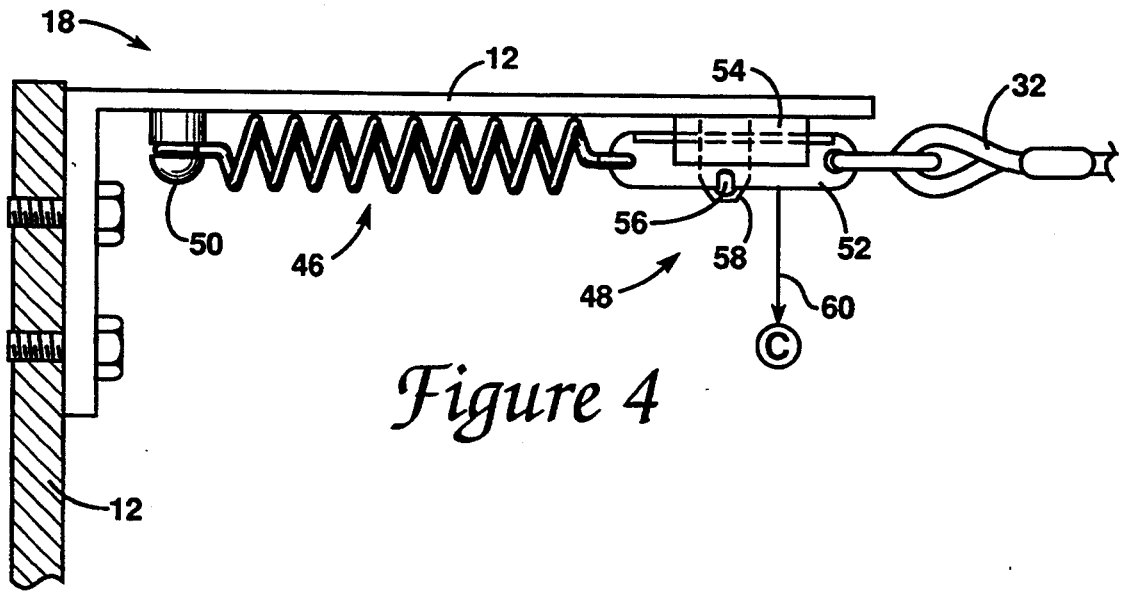
FIG. 4 is a detail view of the spring/timing means connected to the frame and the support means.

FIG. 4 is a detail view of the sensing assembly 18, which comprises spring 46 and a detector assembly 48. One end of spring 46 is coupled to the frame 12 by an anchor 50. The other end of spring 46 is coupled to detector assembly 48 which, in turn, is coupled to cord 32.

Detector assembly 48 is operative to start the timer in computer 22 when the ball 14 is hit by the player. To accomplish this, timing device 48 includes a plate 52 that can slide within a guide 54 coupled to the frame 12. Plate 52 includes a notch 56 that may pass between an emitter/detector 58. Emitter/detector 58 is preferably an infrared LED/phototransistor combination that outputs a signal when the beam from the emitter is first detected by the detector.

Notch 56 has an initial resting position behind the emitter/detector 58 when ball 14 is at rest. As ball 14 is hit, ball suspension cord 34 is pulled and plate 52 slides forward within guide 54. When the notch 56 aligns with the emitter/detector 58, a signal is sent to the computer 22 that the ball has been struck. Computer 22 then starts an internal timer.

Figure 5:
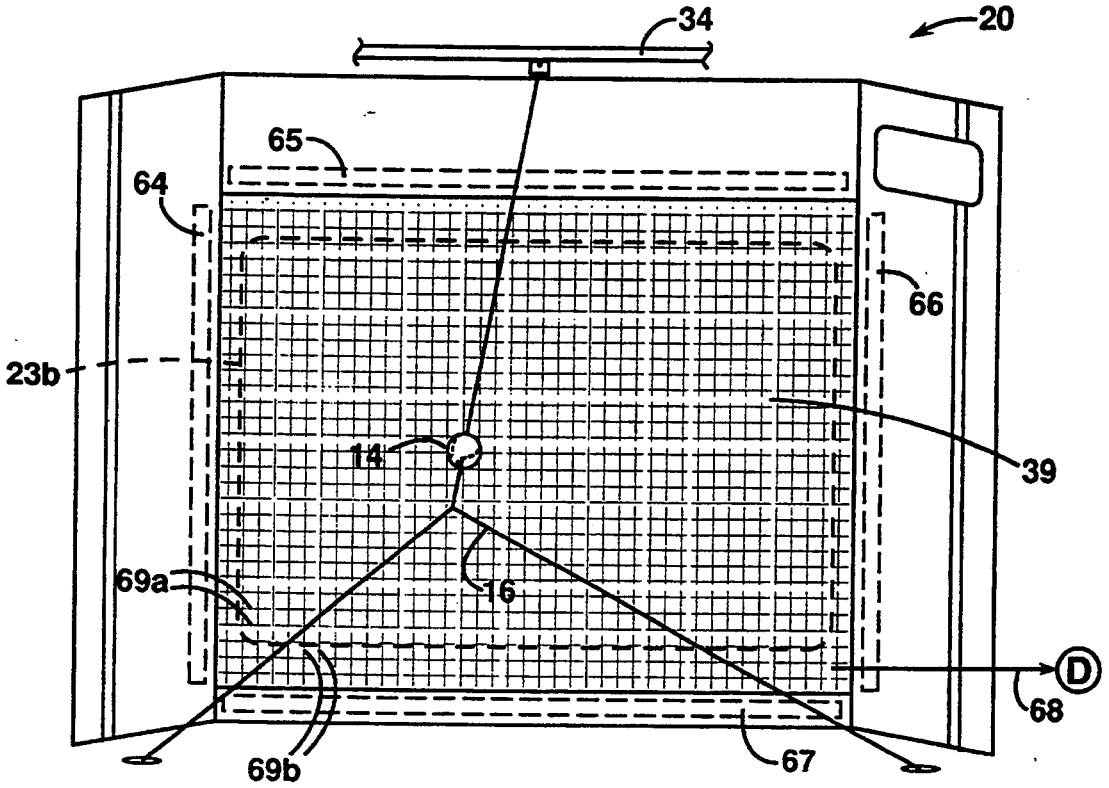
FIG. 5 is a front view of the detector assembly, ball, and ball support.

FIG. 5 is a front view of the detector assembly 20 with the ball 14 in its known, initial position. Detector assembly 20 comprises two rows of emitters 64 and 65 and two rows of detectors 66 and 67. The screen 39 behind the detector assembly is preferably a strong, resilient material that can receive and absorb many collisions from the ball 14 without incurring visible damage from the collisions. A fiat canvas fabric is suitable for the screen 39 if there is no visual feedback from a video monitor. Alternately, a curved or angled screen can be used. Screen 39 is preferably provided with a silk-screened view of a baseball field with defending players. Or, the visual feedback can be projected onto screen 39 from a projector located in front of the screen 39. Alternately, if the video screen 23*b* is being used to provide visual feedback to the player, the screen 39 is transparent and placed in front of video screen 23*b*. See FIGS. 1 and 7 for a more detailed description of the video screen.

The rows of emitters 64, 65 and detectors 66, 67 of the detector assembly 20 are preferably positioned in front of the screen 39. The emitters and detectors are aligned so that the row of emitters 64 faces the row of detectors 66, and the row of emitters 65 faces the row of detectors 67. The rows of emitters 64 and 65 comprise several individual emitters which preferably transmit a focused beam 69 of infrared light towards the rows of detectors 66 and 67. The rows of detectors 66 and 67 comprise individual detectors that correspond and are aligned with individual emitters across the screen 39. The emitters are positioned to transmit several horizontal beams of light 69*a* from one row 64 and several vertical beams 69*b* from the other row 65, thereby forming an x-y grid of light beams in front of the screen 39. The emitters and detectors are spaced so that when the ball 14 intercepts the grid of light beams, a horizontal infrared beam and a vertical infrared beam are blocked. Depending on its trajectory, the ball 14 might also block two horizontal beams, two vertical beams, or all four beams defining a square in the grid. The horizontal and vertical detectors 66 and 67 locate the blocked beams and thus the cartesian (x-y) coordinates of the ball interception with the grid; the final position of the ball is thus found. Once the ball passes through the grid of light beams, it collides with the screen 39 and recoils back to its initial position in front of the player.

In an alternate embodiment, the screen 39 is a flexible tarp that can be positioned in front of the grid of light beams formed by the rows of emitters 64 and 65. When ball 14 impacts screen 39, the screen stretches back at the impact location and intercepts the grid of light beams so that the x-y coordinates of the final position of ball 14 are known.

Other detection methods can also be used. For example, different wavelengths of light besides infrared can be used with optical detectors. Also, the wavelengths of light can be frequency-encoded to reduce the interference produced by surrounding ambient light. Or, instead of a grid of light beams and detectors, an x-y grid wires can be placed in the screen 39. Similar methods of detecting a ball from a grid of horizontal and vertical detectors can be employed with a variety of electrical devices.

As stated above, a curved or angled screen 39 can also be used. With a curved screen, a cartesian (x-y) coordinate system may not be the most efficient system to use for detecting the ball's final position. Polar or cylindrical coordinates, or even user-defined coordinates, can be suitable in such an embodiment.

The detector assembly 20 sends a signal corresponding to the x-y coordinates of the ball impact to the computer 22 over bus 68, which is coupled to input port D on the computer 22. The computer 22 stops the timer that was started by sensing assembly 18 when it receives the x-y coordinates from the detector assembly 20.

Figure 6:
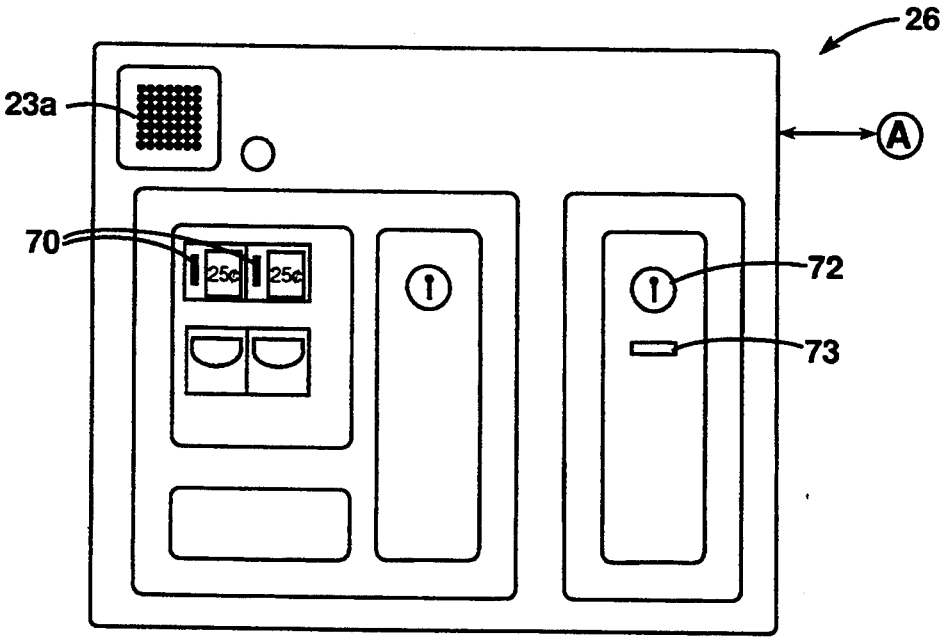
FIG. 6 is a detail view of the coin box of the game unit.

FIG. 6 is a detail view of the coin box 26, which comprises a coin deposit slot 70 and a ticket dispenser 72. The coin deposit slot 70 accepts standard currency coins or game tokens that are normally available in an arcade environment, and also includes a coin return button and coin return slot. The coin box can also include a dollar bill acceptor to facilitate playing the game. Coin boxes suitable for use in game simulation unit 10 are readily available. Coin box 26 also preferably includes a ticket dispenser 72, which dispenses a ticket award to the player based on the final game score from a slot 73. A certain quantity of tickets can be dispensed for every run scored, hit made, etc. Other awards may be chosen by the game owner; possibilities include tickets that, when saved to some predetermined amount, are worth various prizes; or baseball or other sports cards could also be dispensed.

Coin box 26 includes a bi-directional bus 29 coupled to input port A of the computer 22. The coin box sends a signal to the computer when a coin is deposited in the coin deposit slot 70; this signal indicates to the computer to begin a game. Similarly, the computer sends a signal on bus 29 to the coin box 26 when a specific number of tickets must be dispensed according to the game results.

Figure 7:
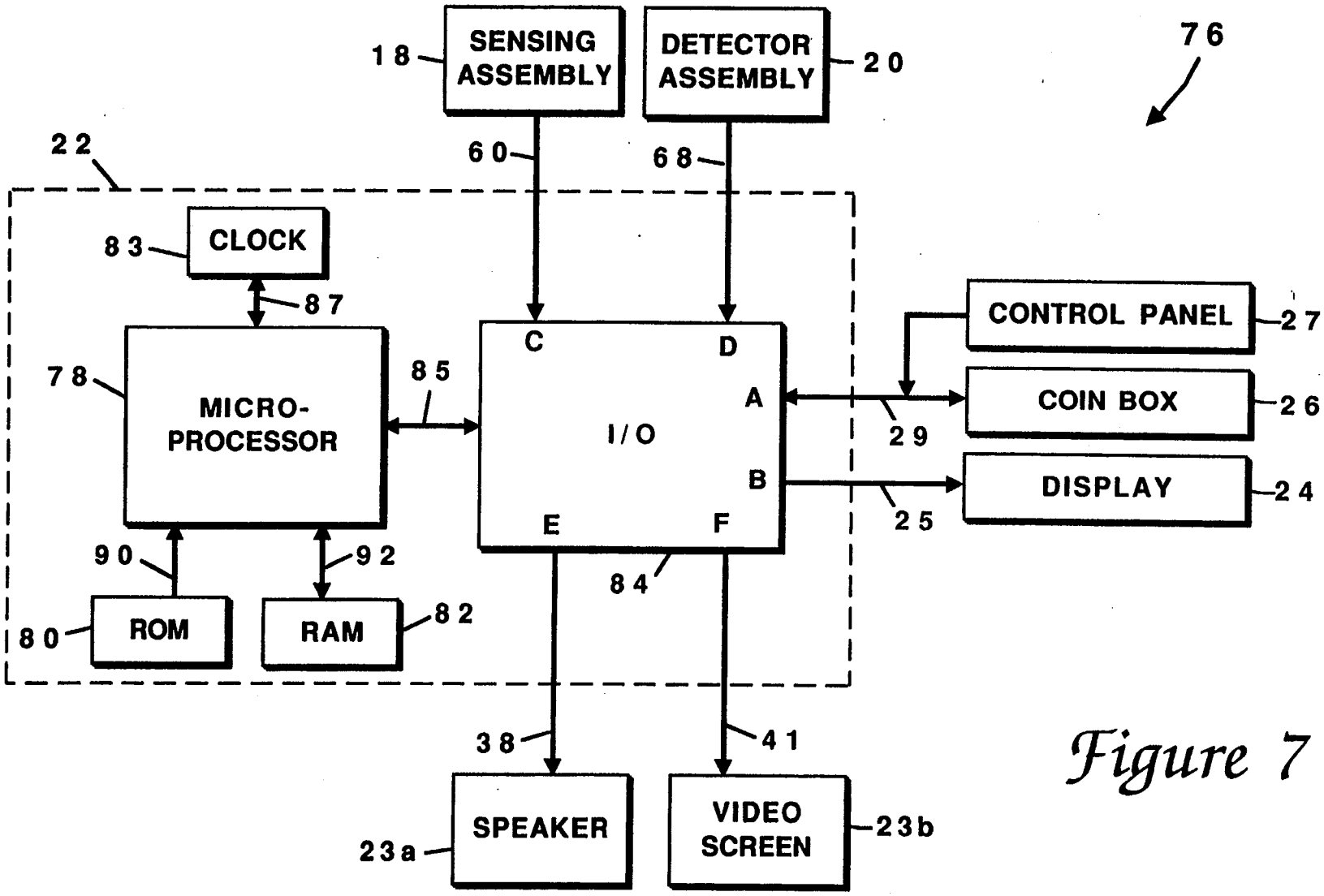
FIG. 7 is a block diagram of the computer control system for a simulator game unit of the present invention.

FIG. 7 is a block diagram of a control system 76 of the computer 22. The components include a microprocessor 78, read-only memory (ROM) 80, random access memory (RAM) 82, clock 83, and input/output (I/O) circuitry 84.

The microprocessor 78 is preferably a commercially-available, single chip microprocessor, such as Siemans 80C535. The microprocessor 78 is coupled to ROM 80 by a data bus 90. The ROM 80 is preferably an erasable, programmable, read-only memory (EPROM) that contains the software instructions and operating system for the microprocessor 78. Microprocessor 78 is connected to RAM 82 by bus 92 to permit the use of RAM for scratch-pad memory. Methods of coupling ROM 80 and RAM 82 to the microprocessor 78 by busses 90 and 92 including enable, address, and control lines are well-known to those skilled in the art.

The microprocessor 78 is also coupled to clock 83. Clock 83 provides a series of clock pulses and is typically coupled to an interrupt port of microprocessor 78 by data line 87. The clock pulses are used to time various functions and events relating to the computer 22, including the timing of the ball 14 as it travels from its intial position to its final position. The clock 83 can also be eliminated and replaced by a clock internal to microprocessor 78, although this tends to be wasteful of microprocessor computing power.

The microprocessor 78 is also coupled to I/O circuitry 84. I/O circuitry 84 typically includes a number of latches, registers, direct memory access (DMA) circuitry, buffers, etc. to provide an interface between the microprocessor 78 and such peripheral devices as detector assembly 20, sensing assembly 18, speaker 23*a*, video screen 23*b*, display 24, coin box 26, and control panel 27.

The control and data lines coupling the microprocessor 78 to the sensing assembly 18, detector assembly 20, display 24, coin box 26, and control panel 27 are well-known in the art. Speaker 23*a* preferably is coupled to audio circuitry included in I/O circuitry 84 to output audio to the player of the game. Such circuitry includes a sound chip, an amplifier, a low pass filter, and sound EPROMs.

Video screen 23*b* is preferably coupled to video driving circuitry included in I/O circuitry 84. Such circuitry includes control circuitry needed to create a graphical output on the video screen using control signals and data from the microprocessor 78. Also included is direct memory access (DMA) circuitry coupled to the microprocessor 78 and ROM 90 for quickly updating and displaying graphical images. Such video driving circuitry can also be included on a separate video control board coupled to output port F of the computer 22.

Figure 8:
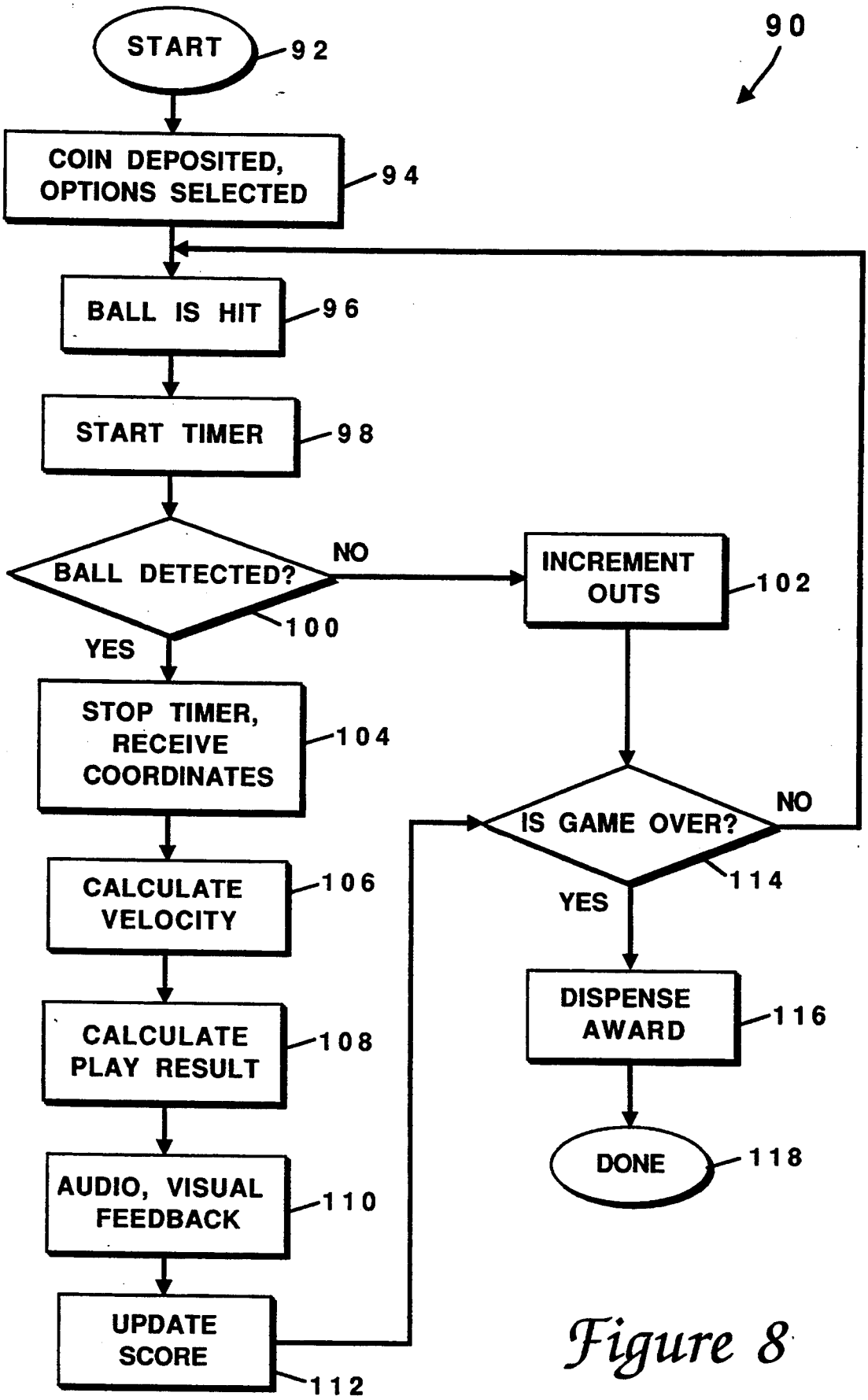
FIG. 8 is a flow diagram of the process of simulating the game of the present invention.

FIG. 8 is a flow diagram 90 of the process of simulating a baseball game of the present invention. The process starts in step 92, and, in a step 94, a coin is deposited by a player in coin deposit slot 70 of coin box 26. A start signal is sent on bus 29 to computer 22 to begin a game, and the computer 22 outputs various audio and visual effects. Also in step 94, the player selects the settings and options of the game on control panel 27, such as skill level, team name, ball height, etc. The player then enters the game unit 10 through door 28 and picks up bat 42.

In a step 96, the player hits ball 14 with bat 42 towards detector assembly 20 when prompted by computer 22 with feedback means 23*a* and 23*b*. As the ball 14 initially travels forward, the timer in computer 22 is started in step 98 by a signal on bus 60 from sensing assembly 18.

The ball 14 should reach detector assembly 20 in a short amount of time. If the ball is detected within a predetermined amount of time in step 100, the game proceeds to step 104. If the ball is not detected in that amount of time, the hit is assumed to have been erratic or a "pop fly", and step 102 is initiated. In step 102, the number of outs assigned to the player is incremented, and in next step 114, the status of the game is checked (detailed below).

If the ball is detected in step 100, step 104 is initiated. The ball 14 momentarily blocks a horizontal light beam(s) and a vertical light beam(s) of emitters 64 and 65, and the detectors 66 and 67 send this information concerning the x-y coordinates to the computer 22 over bus 68. In step 104, the computer reads the coordinates of the ball's final position and also stops the timer the moment it receives the coordinates. The computer then calculates a velocity vector in step 106 from the time and position information it has received.

The velocity is calculated using the well-known physics equation:

$$\vec{V} = \vec{v}\sqrt{(x_1 - x_2)^2 + (y_1 - y_2)^2 + (z_1 - z_2)^2}$$

where $(x_1, y_1, z_1)$ are the spatial coordinates of the known initial position of the ball 14, $(x_2, y_2, z_2)$ are the spatial coordinates of the final position of the ball detected by detector assembly 20, and $\nu$ is the unit vector pointing from $(x_1, y_1, z_1)$ to $(x_2, Y_2, z_2)$. The magnitude of the velocity is calculated using the equation:

$$|V| = \frac{\sqrt{(x_1 - x_2)^2 + (y_1 - y_2)^2 + (z_1 - z_2)^2}}{\Delta t}$$

where $(x_1, y_1, z_1)$ are the spatial coordinates of the initial position of the ball 14, $(x_2, y_2, z_2)$ are the spatial coordinates of the final position of the ball, and $\Delta t$ is the time measured from the initial position of the ball to the final position of the ball.

In the preferred embodiment, the coordinates x and y are measured relative to an origin at the bottom left corner of the detector assembly 20 in units equal to the spacing between the individual emitters and detectors of the detector assembly 20. The expression $(z_1 - z_2)$ is the perpendicular distance between the initial position of the ball and the optical grid 69 of the detector assembly 20 in the same units used for x and y. In the preferred embodiment, the magnitude of the velocity is quantized into one of three categories of "slow", "medium", and "fast" which allow high enough precision to calculate a play result. The more precise velocity magnitude calculated above can be used for more experienced players who can distinguish velocities in a greater range.

Once the velocity is calculated, the computer calculates the play result in step 108. The trajectory of the ball is first calculated using the initial velocity of the ball and well-known ballistic calculations. The direction and magnitude of the velocity is used by the computer 22 to calculate the trajectory of the ball 14 assuming ideal conditions. Ballistic physics equations that can predict the trajectory of an object in space using the known velocity of the object, the angle of the initial trajectory of the object, and constants such as gravity are well-known in the art. Since the initial position of the ball 14 is known, the direction component of the ball's velocity is precisely known, allowing the trajectory of the ball to be accurately determined.

Once the trajectory is calculated, the computer determines the play result. The hit is determined to be a base hit, foul, out, or home run. For example, if the calculated trajectory of a hit ball indicates that the ball would travel 350 feet in a high arc, the computer designates the hit as a home run. If the trajectory of the ball is between the simulated second baseman and shortstop but "on the ground", the hit can be designated a base hit and a simulated base runner can be positioned at a simulated first base and stored in memory.

The complexity of the calculated trajectory of the ball and simulated play result can vary. The computer can simulate fielding players that may or may not be able to catch a ball or throw an out to a base. Average player running speeds and throwing accuracy can be programmed into the software of the computer 22 so that the probability of a fielding player to field the ball and make an out can be calculated and implemented to achieve the play result. Random errors by the simulated players can also be simulated by software. In a different embodiment, the skills of these simulated players can be selected by the player in step 94. The software to control such simulations is well-known in the art.

In step 110, the computer 22 outputs audio and visual feedback to the player. The feedback is based upon the result of the play calculated in step 108. For example, if the hit is a home run, cheering crowd sounds and announcer comments can be output from speaker 23*a*. Similarly, animated images such as a baseball flying out of the stadium or a player running around the bases can be displayed on video screen 23*b*.

In step 112, the score and other information shown on display 24 is updated according to the play result calculated in step 108. Runs scored, outs, and current inning are some of the information updated, if necessary, in this step.

In step 114, the computer checks if the game is over. In the preferred embodiment, the current number of outs is compared to a maximum number of three. If the number of outs is less than three, the game resumes at step 96. If the outs are equal to three, the game is over and the computer outputs appropriate feedback to the player indicating the current status of the game. Other criteria can be used to determine when the game is over. For example, a time limit can be imposed so that, when the time expires, the game is over. Or, the number of innings can determine the length of a game. If two players are playing, one S player can bat until three outs are accumulated, followed by the second player. When both players haven taken turns, the inning number is incremented.

Once the game is determined as over in step 114, an award is dispensed to the player in step 116 if an embodiment of the game with awards is being used. The award is based upon the score (i.e. number of runs) of the game displayed on display 24. Alternately, the award can be based upon the number of base hits made, home runs made, slugging percentages, etc. As described above, the award in the preferred embodiment is a number of tickets dispensed from ticket dispenser 72 of coin box 26. Once the award is dispensed, the game is complete as indicated in step 118.

While this invention has been described in terms of several preferred embodiments, it is contemplated that alterations, modifications and permutations thereof will become apparent to those skilled in the art upon a reading of the specification and study of the drawings. It is therefore intended that the following claims include ail such alterations, modifications and permutations as fall within the spirit and scope of the present invention.

What is claimed is:

1. A baseball game simulator comprising:

a ball;

a support physically attached to said ball at a known initial position;

a detector to detect a final position of said ball after said ball has been hit by a bat;

means for measuring a period of time said ball took to travel between said initial position and said final position, wherein said timer is coupled to said support such that said timer is activated by movement of said support when said ball is hit by said bat;

means for calculating velocity from said initial position, said final position and said period of time; and means for providing user feedback of a user's progress in a simulated game, said feedback being derived at least in part from said calculated velocity of said ball.

2. A baseball game simulator as recited in claim 1 wherein said support includes a cord suspending said ball above a playing surface.

3. A baseball game simulator as recited in claim 2 wherein said support further includes a tether coupled to said ball.

4. A baseball game simulator as recited in claim 2 wherein said support includes a sensor coupled to said cord to trigger said means for measuring a period of time.

5. A baseball game simulator as recited in claim 1 wherein said detector includes a sensing assembly which provides coordinates of said final position.

6. A baseball game simulator as recited in claim 5 wherein said sensing assembly includes an array of optical sensors.

7. A baseball game simulator as recited in claim 1 wherein said means for calculating velocity includes digital computation means, said digital computation means being further operative to calculate a simulated result of said simulated game based upon rules of said game, said velocity, and performance of simulated players of said game, wherein said simulated result is the subject of said auditory feedback.

8. A baseball game simulator as recited in claim 1 further comprising dispenser means operative to dispense a physical award.

9. A method for simulating a baseball game comprising:

(a) supporting a ball at a known initial position;

(b) hitting said ball;

(c) detecting a final position of said ball;

(d) measuring a period of time said ball took to travel between said initial position and said final position;

(e) calculating a velocity from said initial position, said final position, and said period of time;

(f) calculating an indication of a current state of a simulated game based upon said calculated velocity;

(g) providing user feedback of progress in said simulated game, said user feedback being derived at least in part from said calculated velocity of said ball, said user feedback including said indication of said current state of said game in relation to a condition for ending said simulated game; and (h) repeating steps (a) through (g) until said user accomplishes said condition for ending said simulated game.

10. A method as recited in claim 9 wherein said step of hitting said ball includes hitting said ball with a bat.

11. A method as recited in claim 9 wherein said step of detecting the final position of said ball includes detecting the position of said ball as it impinges upon a sensing assembly.

12. A method as recited in claim 11 wherein said step of measuring a period of time includes the step of starting a timer as said ball is being hit and stopping said timer when said ball impinges upon said sensing assembly.

13. A method as recited in claim 9 wherein said step of calculating said velocity is accomplished by using the formula:

$$\vec{V} = \vec{v}\sqrt{(x_1 - x_2)^2 + (y_1 - y_2)^2 + (z_1 - z_2)^2}$$

where $v$ is the unit vector pointing from $(x_1, y_1, z_1)$ to $(x_2, y_2, z_2)$.

14. A method as recited in claim 9 wherein said step of providing user feedback includes calculating a play result based upon the calculated velocity, rules of said game, and the performance of simulated players of said game.

15. A method as recited in claim 14 wherein said step of providing user feedback includes auditory feedback indicating the play result.

16. A method as recited in claim 14 wherein said step of providing user feedback includes visual feedback indicating the play result.

17. A method as recited in claim 14 wherein a series of play results are used to calculate a game result.

18. A method as recited in claim 14 wherein said step of calculating an indication of the current state of a game based upon said calculated velocity includes incrementing a number of outs in said game based upon said calculated play result.

19. A baseball game simulator comprising:

a ball;

a support attached to said ball to position said ball in a known initial position, wherein a sensor is coupled to said ball by said support to provide an output when said ball moves from said initial position;

means for determining a simulated flight of said ball after said ball has been struck by a bat, wherein said means for determining a simulated flight utilizes said output of said sensor, in part, to determine said flight;

means for calculating a simulated result of said simulated flight and updating the status of a simulated baseball game; and feedback means providing a player with information concerning said updated status of said simulated baseball game.

20. A baseball game simulator as recited in claim 18 wherein said support includes a cord suspending said ball at said initial position.

21. A baseball game simulator as recited in claim 18 wherein said means for determining a simulated flight of said ball includes a detector/operative to detect a final position of said ball.

22. A baseball game simulator as recited in claim 21 wherein said means for determining a simulated flight of said ball includes timing means operative to measure the period of time said ball took to travel between said initial position and said final position.

23. A baseball game simulator as recited in claim 18 wherein said means for calculating a simulated result of said simulated flight includes a digital computer.

24. A baseball game simulator as recited in claim 19 wherein said feedback means includes a scoring display operative to display a score based upon a simulated result of said simulated flight of said ball.

25. A baseball game simulator as recited in claim 19 wherein said feedback means includes auditory feedback means.

26. A baseball game simulator as recited in claim 19 wherein said feedback means provides visual feedback to the player.

27. A method as recited in claim 18 wherein said condition for ending said simulated game includes incrementing said number of outs to a predetermined number.

28. A method for simulating a baseball game comprising:

(a) supporting a ball at a known initial position;

(b) striking said ball with a bat;

(c) detecting said ball at a final position after said bail has been struck by a bat, wherein a number of outs is increased if said ball is not detected at said final position within a predetermined period of time;

(d) determining a simulated flight of said ball;

(e) calculating a simulated play result of said simulated flight and updating the status of a simulated baseball game, including increasing said number of outs when said play result is calculated to be an out according to predetermined rules;

(f) providing a player with information concerning said simulated play result and said updated status of said simulated baseball game including displaying an updated score based on said updated status; and (g) repeating steps (a) through (f) until said number of outs is equal to a predetermined number.

29. A method as recited in claim 28 wherein said step of repeating steps (a) through (f) until said number of outs is equal to a predetermined number includes repeating steps (a) through (f) until said number of outs is equal, to a predetermined number or a predetermined time limit has expired as measured from said first occurrence of said detection of said ball.

30. A method as recited in claim 28 wherein a number of innings is increased when said number of outs is incremented to a predetermined number, and wherein said step of repeating steps (a) through (f) includes repeating steps (a) through (f) until said number of outs is equal to a first predetermined number or said number of innings is equal to a second predetermined number.

31. A method as recited in claim 28 wherein said step of providing said player with information includes providing audio and visual feedback concerning said simulated play result and updated status of said simulated baseball game.

32. A method as recited in claim 31 wherein said step of determining a simulated flight of said ball includes measuring the period of time said ball took to travel between said initial position and said final position.

33. A method as recited in claim 28 wherein said step of calculating a simulated play result of said simulated flight includes simulating fielding players with simulated baseball skills.

34. A method as recited in claim 33 wherein said simulated skills of said simulated fielding players are variable and selectable by said player.

35. A method as recited in claim 28 further comprising a step of providing an award to said player based upon said simulated play result.

36. A baseball game simulator comprising:

a ball means;

cord means for suspending said ball means at a known initial position above a playing surface, wherein said cord means includes a sensing means coupled to said cord means;

means for detecting a final position of said ball means after said ball means has been hit by a bat means;

means for measuring a period of time said ball means took to travel between said initial position and said final position, wherein said sensing means is operative to trigger said means for measuring a period of time;

means for calculating velocity from said initial position, said final position and said period of time; and means for providing user feedback derived at least in part from said velocity.

37. A baseball game simulator comprising:

a ball means;

means for supporting said ball means at a known initial position;

means for detecting a final position of said ball means after said ball means has been hit by a bat means;

means for measuring a period of time said ball means took to travel between said initial position and said final position, wherein said means for measuring a period of time includes means for sensing when said ball means has been hit by said bat means at said known initial position, said means for sensing being attached to said ball means by a flexible cord means;

means for calculating velocity from said initial position, said final position and said period of time; and means for providing user feedback derived at least in part from said calculated velocity of said ball means.

* * * * *